US010056184B2

(12) United States Patent
Daily et al.

(10) Patent No.: US 10,056,184 B2
(45) Date of Patent: Aug. 21, 2018

(54) SEGMENTED CORE CAP SYSTEM FOR TOROIDAL TRANSFORMERS

(71) Applicants: Madison Daily, Rolla, MO (US); John Park, Rolla, MO (US)

(72) Inventors: Madison Daily, Rolla, MO (US); John Park, Rolla, MO (US)

( * ) Notice: Subject to any disclaimer, the term of this patent is extended or adjusted under 35 U.S.C. 154(b) by 35 days.

(21) Appl. No.: 14/887,824

(22) Filed: Oct. 20, 2015

(65) Prior Publication Data

US 2017/0110238 A1 Apr. 20, 2017

(51) Int. Cl.

| | |
|---|---|
| ***H01F 27/30*** | (2006.01) |
| ***H01F 27/32*** | (2006.01) |
| ***H01F 41/08*** | (2006.01) |
| ***H01F 41/098*** | (2016.01) |

(52) U.S. Cl.

CPC ..... *H01F 27/325* (2013.01); *H01F 41/08* (2013.01); *H01F 41/098* (2016.01)

(58) Field of Classification Search

CPC ..... H01F 27/325; H01F 41/08; H01F 41/098; H01F 5/02; H01F 27/324; H01F 17/06; H01F 17/062; H01F 30/16

USPC ..... 336/198, 208, 229, 199, 196, 211, 219; 29/605

See application file for complete search history.

(56) References Cited

U.S. PATENT DOCUMENTS

| | | | | |
|---|---|---|---|---|
| 3,340,489 | A * | 9/1967 | Bastis | B01J 21/02 336/192 |
| 4,728,919 | A | 3/1988 | Dirmeyer | |
| 4,779,812 | A * | 10/1988 | Fisher | H01F 27/322 242/434.7 |
| 4,847,583 | A | 7/1989 | Bernard | |
| 5,543,773 | A | 8/1996 | Evans et al. | |
| 5,828,282 | A | 10/1998 | Tiemann | |
| 5,952,907 | A | 9/1999 | McWilliams et al. | |
| 6,300,857 | B1 | 10/2001 | Herwig | |
| 6,507,260 | B1 | 1/2003 | Baumann et al. | |
| 7,312,686 | B2 * | 12/2007 | Bruno | H01F 27/263 336/229 |
| 2004/0130428 | A1 | 7/2004 | Mignano | |
| 2010/0323900 | A1 * | 12/2010 | Kawashima | H01F 6/065 505/211 |

(Continued)

FOREIGN PATENT DOCUMENTS

| | | |
|---|---|---|
| GB | 1079935 | 8/1967 |
| JP | 2000299226 | 10/2000 |

(Continued)

*Primary Examiner* — Mangtin Lian

(74) *Attorney, Agent, or Firm* — C John Brannon; Brannon Sowers & Cracraft PC

(57) ABSTRACT

A modular toroidal transformer core cap system, including a plurality of cap segments, wherein each respective cap segment further includes first and second spaced elongated wall members, first and second connector members connected to the respective first and second elongated wall members, and a generally flat panel member connected to and extending between the first and second elongated wall members. The first and second wall members are disposed at a predetermined angle relative one another and the first and second elongated wall members and the panel member are electrically nonconducting. An integral number of cap segments may be joined together to define an annular core cap.

13 Claims, 15 Drawing Sheets

(56) References Cited

U.S. PATENT DOCUMENTS

| | | | | |
|---|---|---|---|---|
| 2011/0025304 | A1* | 2/2011 | Lint | G01R 15/181<br>324/150 |
| 2011/0133874 | A1* | 6/2011 | Prabhakaran | H01F 17/02<br>336/200 |

FOREIGN PATENT DOCUMENTS

| | | |
|---|---|---|
| KR | 101101676 | 10/2001 |
| WO | 2005004181 | 1/2005 |

* cited by examiner

SEGMENTED CORE CAP SYSTEM FOR TOROIDAL TRANSFORMERS

TECHNICAL FIELD

The present novel technology relates generally to toroidal transformer systems, and, more particularly, to a segmented core cap for use with toroidal transformer cores and a method for using the same.

BACKGROUND

A transformer is an electrical device that transfers energy between two or more circuits through the phenomenon of electromagnetic induction. Transformers are commonly used to increase (step-up) or decrease (step-down) the voltages of alternating current in electric power applications. This is accomplished by passing a varying current through the primary winding to generate a magnetic flux in the transformer's core. This flux then induces a voltage in the transformer's secondary winding. Depending on the ratio of the primary windings to the secondary windings, the transformers output voltage can be increased or decreased.

For most transformers designed for small-scale use, such as in devices commonly used in homes or offices, one of two styles of transformers is typically used. These are transformers with either an E-I laminate or a toroidal core (See FIG. 1). In a laminate transformer utilizing an E-I structure, the matching "E" and "I" components are stamped from sheets of thin grain oriented electrical steel, and the sheets are then stacked to create the core. Typically, the primary and secondary windings are wound on bobbins. Multiple bobbins are placed on spindles and spun in order to apply the windings. This method of winding the core with wire supplied on bobbins allows for automation, and so reduces the manufacturing times and also provides insulation between the windings and the core. The E-I core laminations are stacked inside the bobbins to complete the transformer.

In the case of a toroidal core, the core element is typically made from a continuous strip of silicon steel, which is wound like a tight clock spring. The ends are tacked into place with small spot welds, to prevent the coiled steel from unwinding. The core is typically insulated with an epoxy coating or a set of caps or multiple wraps of insulating film, such as MYLAR and/or NOMEX (MYLAR and NOMEX are registered trademarks, reg. no. 0559948 and 86085745, respectively, of the E. I. De Pont de Nemours and Company Corporation, a Delawar Corporation located at 1007 Market Street, Wilmington, Del. 19898). The transformer's windings are applied directly onto the insulated core itself. Additional insulation is required to isolate the windings. Since the windings must be wound through the center hole of the core and the core is one piece, bobbins can't be used on toroidal transformers.

As they do not lend themselves to automation, toroidal transformers are more labor intensive to produce. However, the continuous strip of steel used in the core allows the toroidal transformer to be smaller, lighter, more efficient, and quieter than its E-I laminate counterpart. These qualities are highly desirable in many applications and justify the additional expense.

Thus, there is a need for a toroidal transformer that enjoys the advantages of be smaller size, lighter weight, increased efficiency, and quieter operation while overcoming the drawbacks of being labor intensive and more expensive to produce. The present novel technology addresses these needs.

BRIEF DESCRIPTION OF THE DRAWINGS

For a better understanding of the nature and objects of the present novel technology, reference should be made to the following drawings, in which.

DETAILED DESCRIPTION

Figure 1:
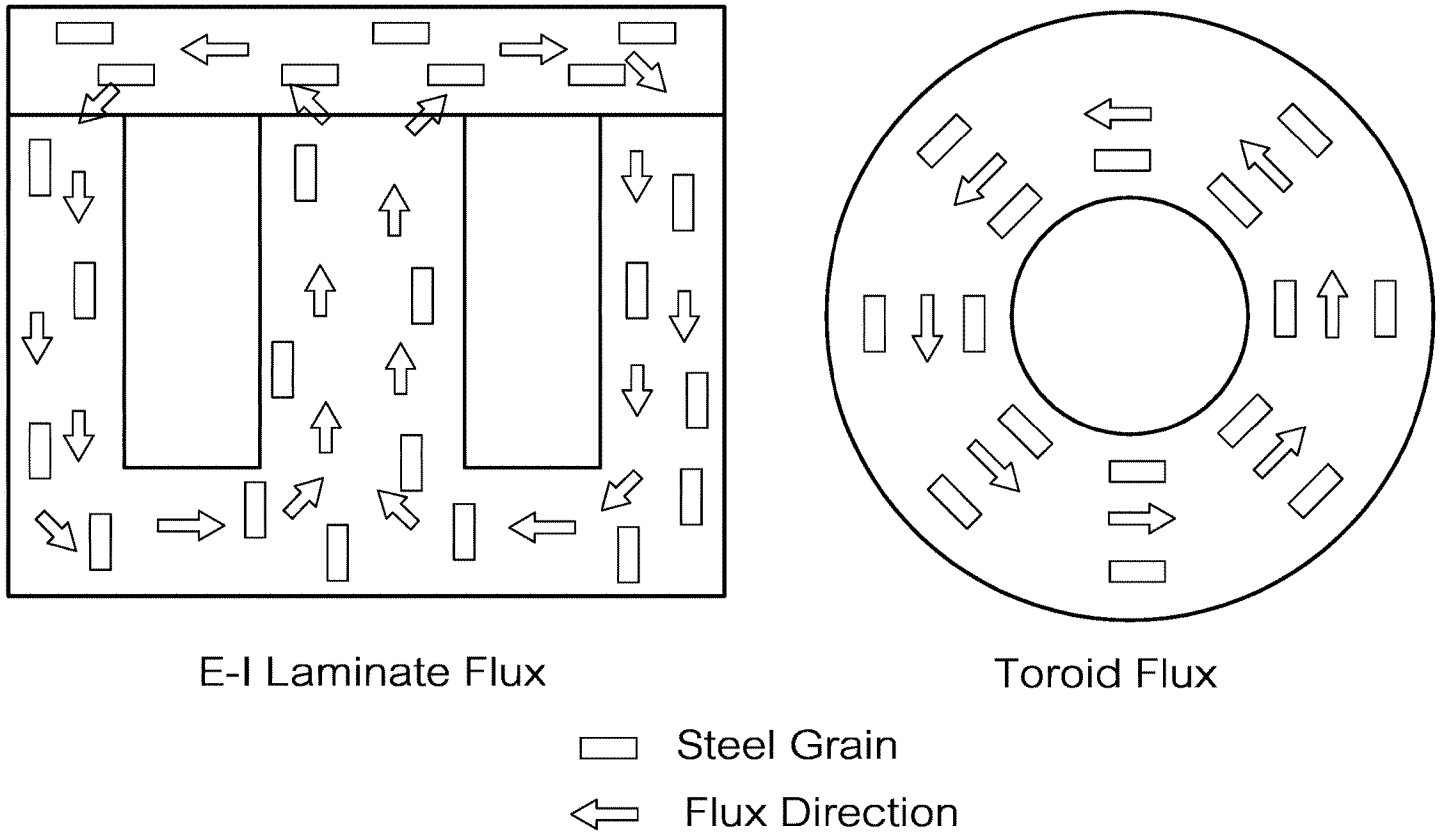
Fig. 1 (Prior Art)
FIG. 1 is a schematic diagram generally illustrating E-I and toroidal transformer designs of the PRIOR ART.

For the purposes of promoting an understanding of the principles of the novel technology, reference will now be made to the embodiments illustrated in the drawings and specific language will be used to describe the same. It will nevertheless be understood that no limitation of the scope of the novel technology is thereby intended, such alterations and further modifications in the illustrated device, and such further applications of the principles of the novel technology as illustrated therein being contemplated as would normally occur to one skilled in the art to which the novel technology relates.

Figure 2A:
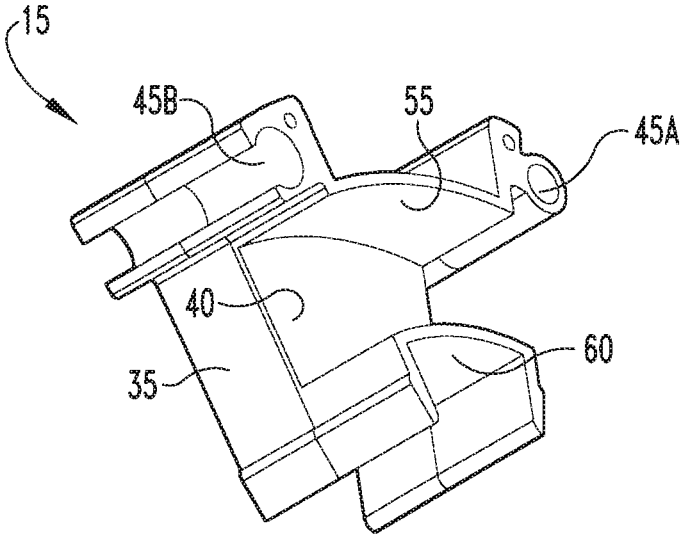
FIG. 2A is a first perspective view of a toroidal cap segment according to a first embodiment of the present novel technology.
Figure 2B:
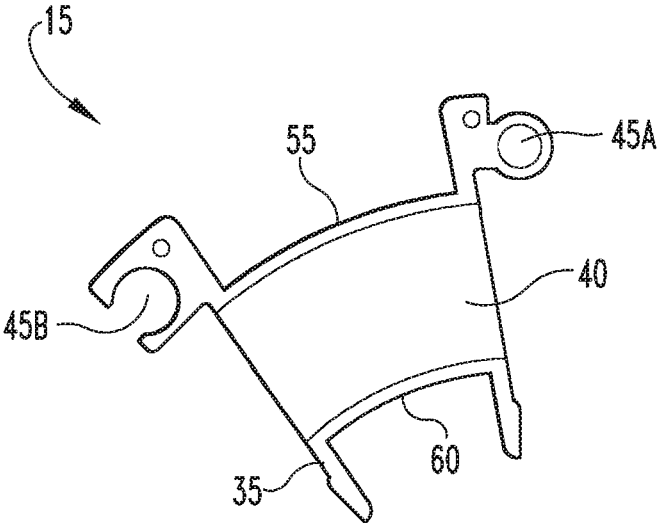
FIG. 2B is a top plan view of FIG. 2A.
Figure 2C:
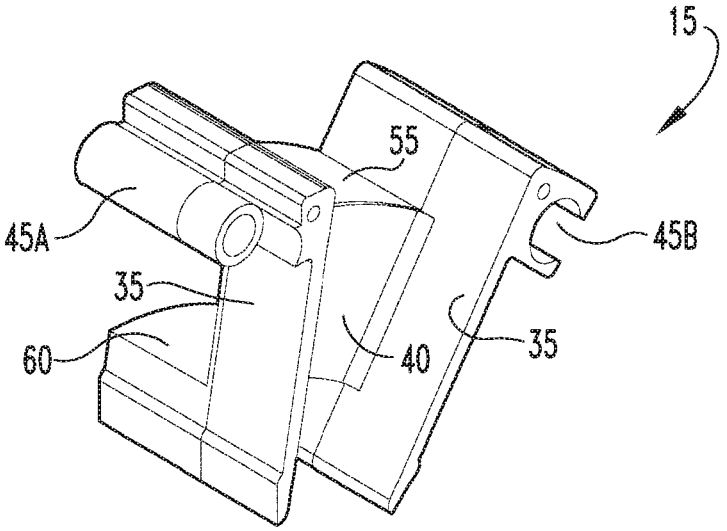
FIG. 2C is a second perspective view of FIG. 2A.
Figure 2D:
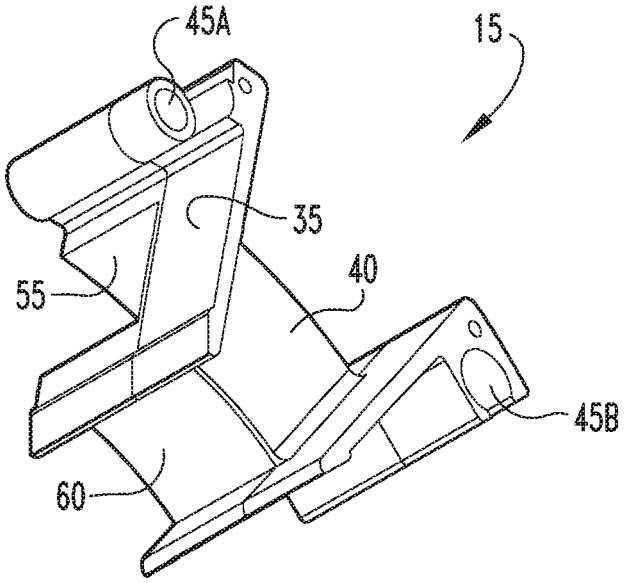
FIG. 2D is a third perspective view of FIG. 2A.
Figure 3A:
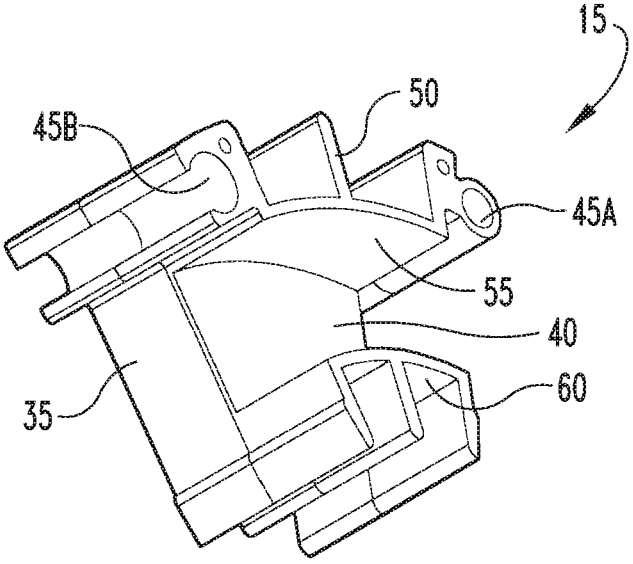
FIG. 3A is a first perspective view of a toroidal cap segment according to a second embodiment of the present novel technology.
Figure 3B:
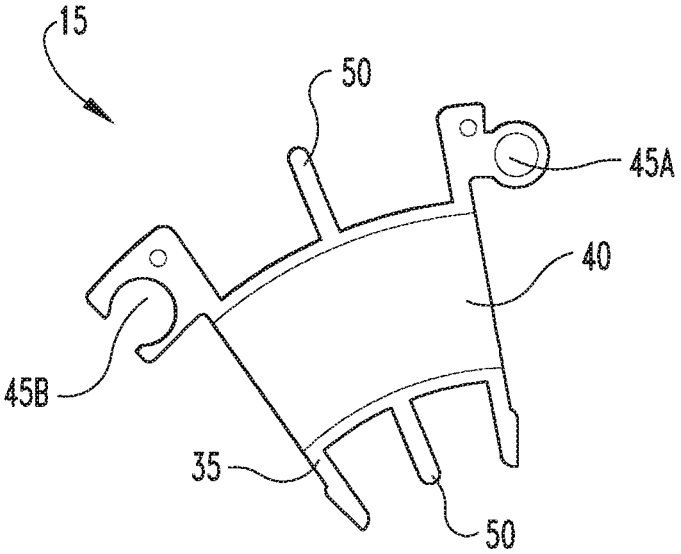
FIG. 3B is a top plan view of FIG. 3A.
Figure 3C:
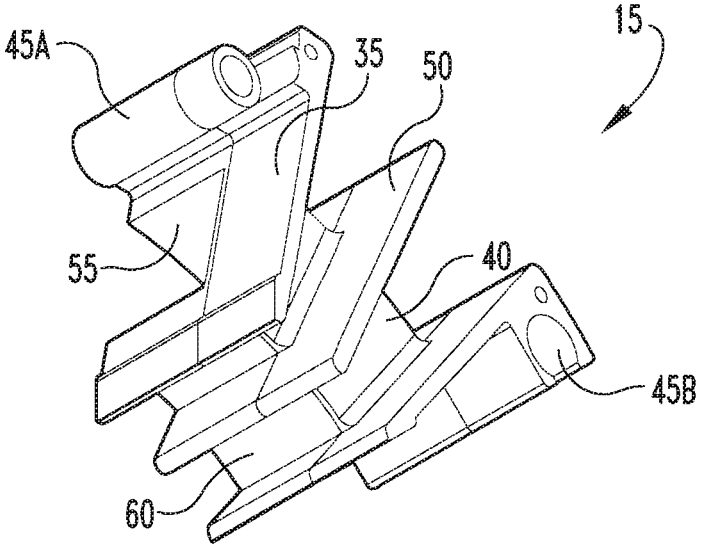
FIG. 3C is a second perspective view of FIG. 3A.
Figure 3D:
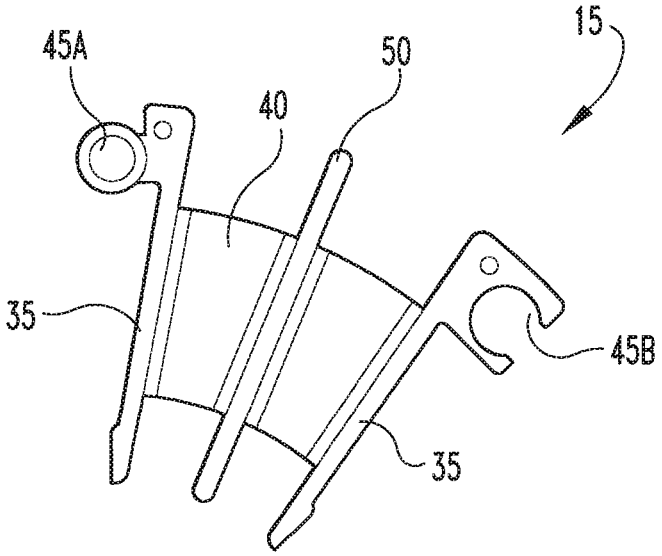
FIG. 3D is a third perspective view of FIG. 3A.
Figure 4:
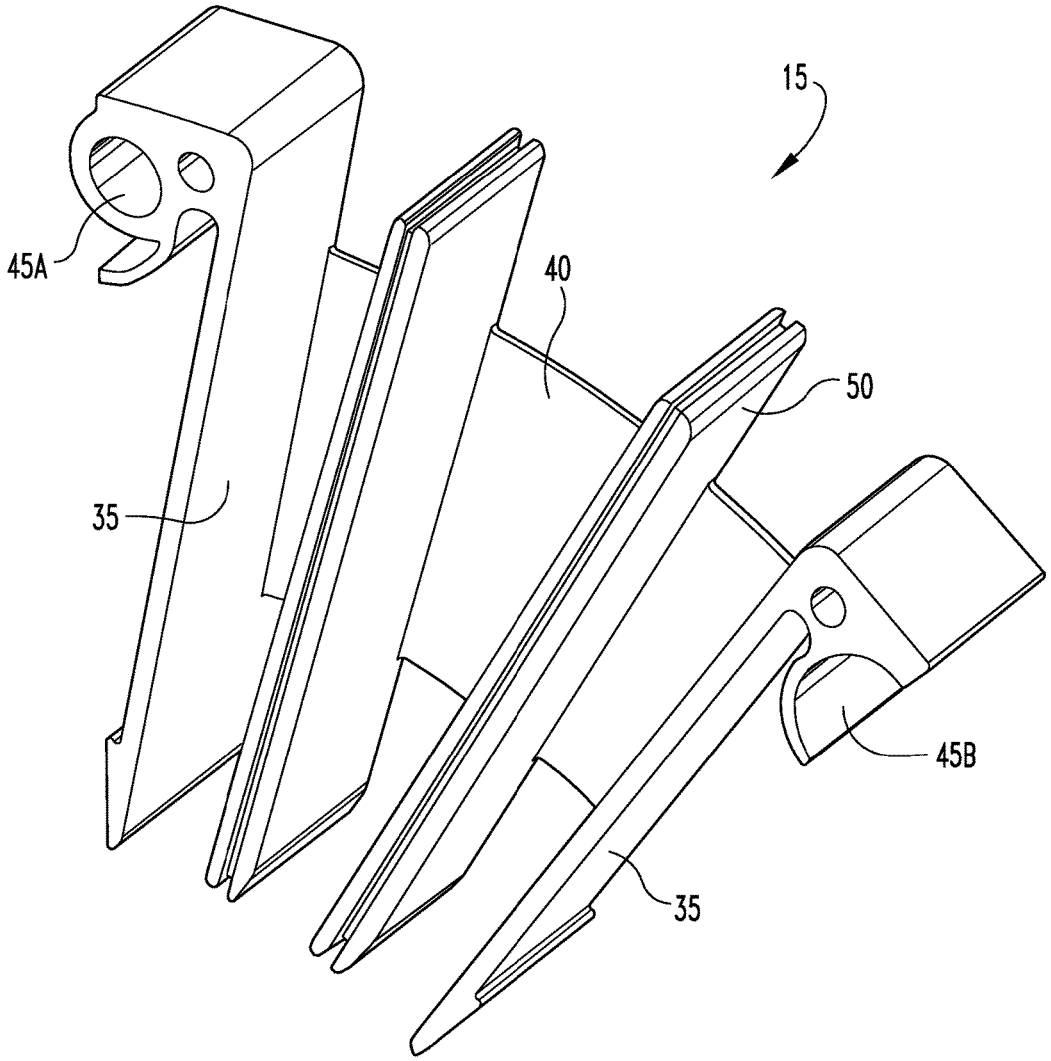
FIG. 4 is a perspective view of a toroidal cap segment according to a third embodiment of the present novel technology.
Figure 5:
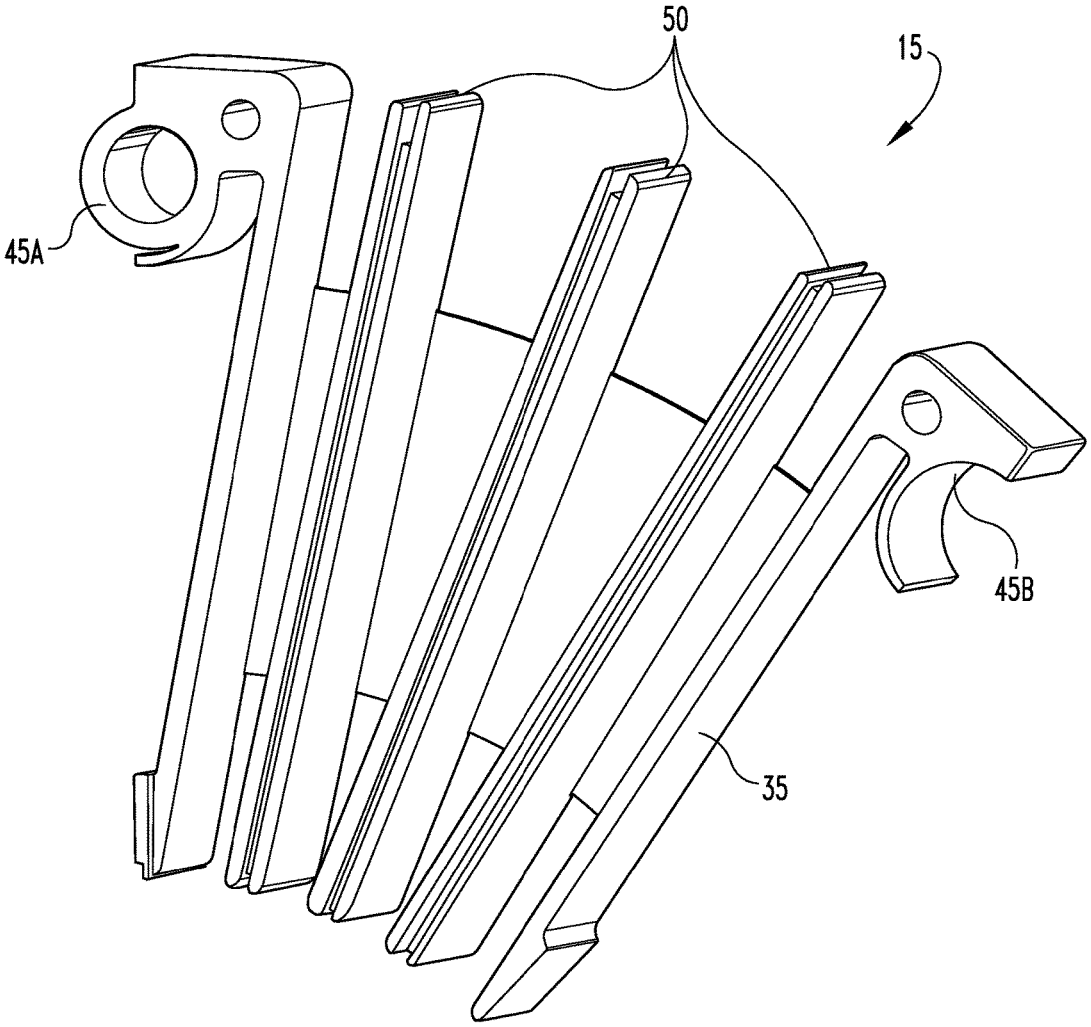
FIG. 5 is a perspective view of a toroidal cap segment according to a fourth embodiment of the present novel technology.
Figure 6B:
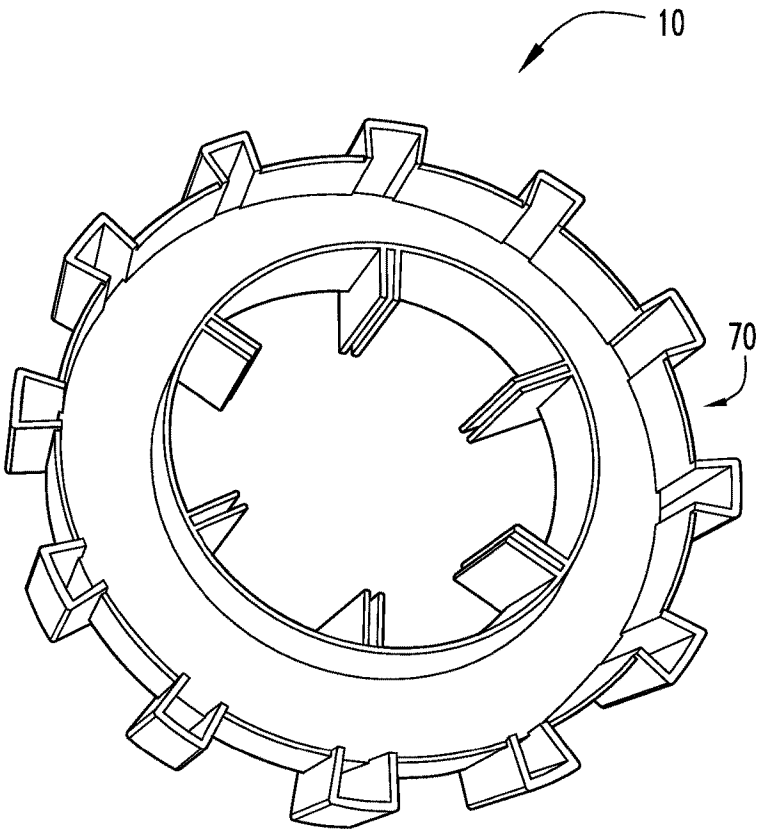
FIG. 6B is a bottom perspective view of FIG. 6A.
Figure 6A:
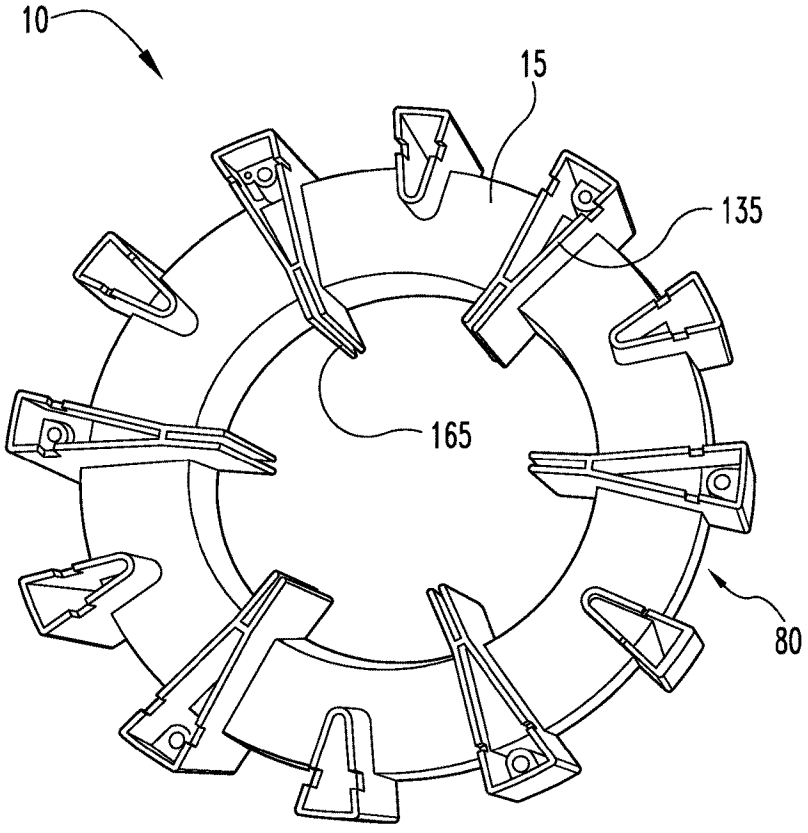
FIG. 6A is a top perspective view of a plurality of segments forming a toroidal core cap ring according to a fifth embodiment of the present novel technology.
Figure 7B:
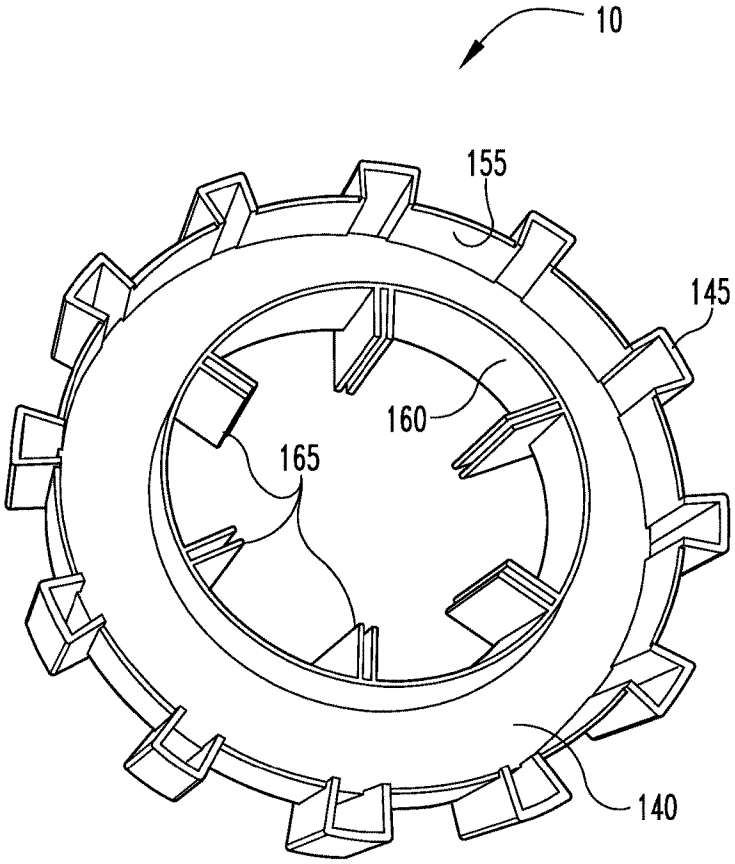
FIG. 7B is a bottom perspective view of FIG. 7A.
Figure 7A:
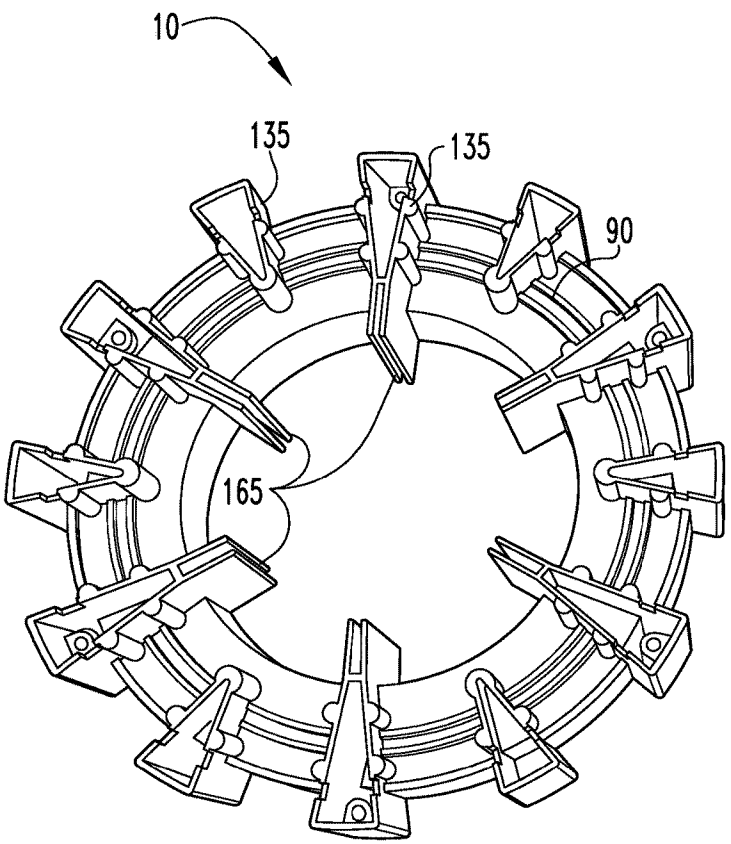
FIG. 7A is a top perspective view of a plurality of segments forming a toroidal core cap ring according to a sixth embodiment of the present novel technology.
Figure 8A:
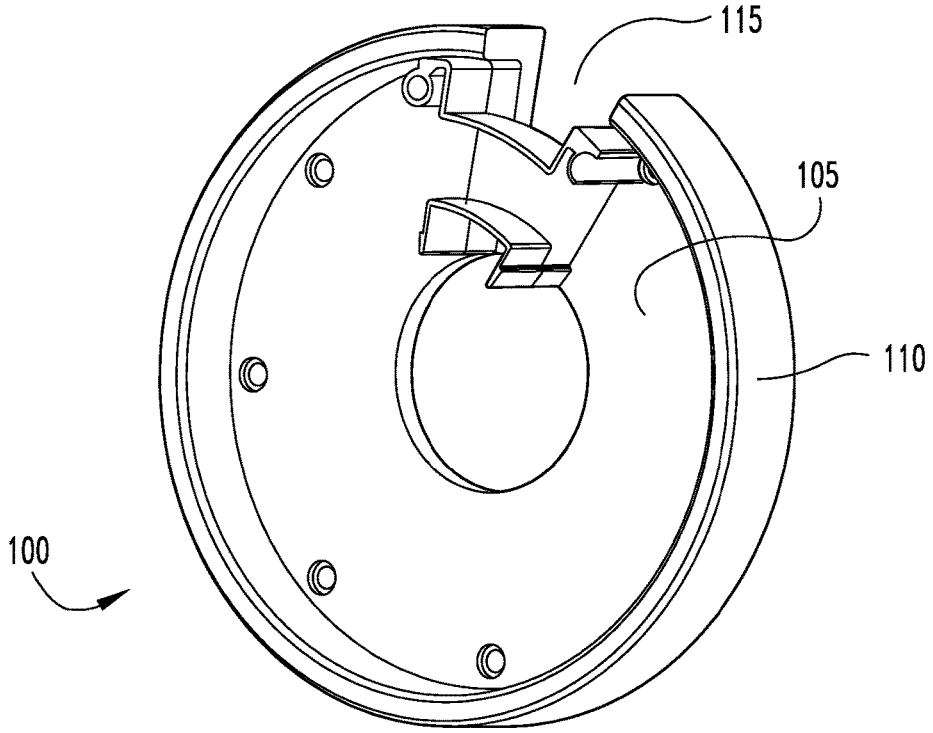
FIG. 8A is a bottom perspective view of a winding tool according to a seventh embodiment of the present novel technology.
Figure 8B:
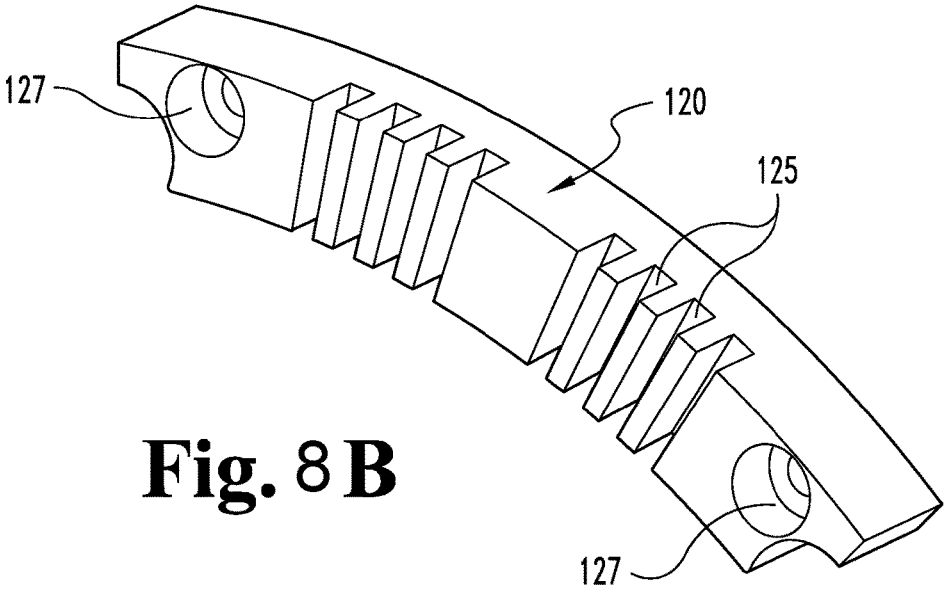
FIG. 8B is a perspective view of a wire lock tool for use with FIG. 8A.
Figure 9A:
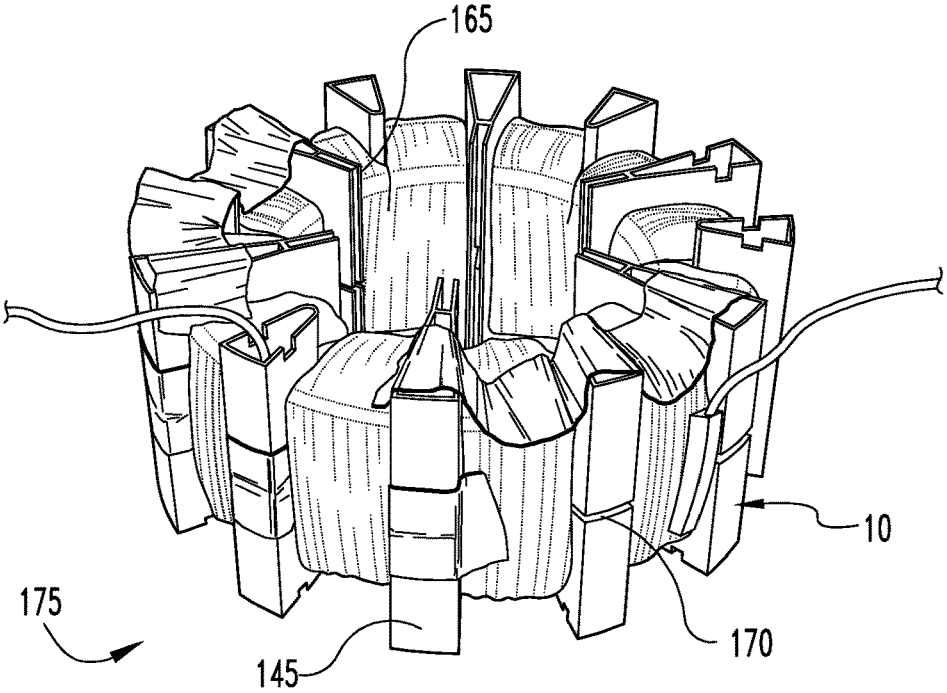
FIG. 9A is a perspective view of a partially wound core using the present novel technology.
Figure 9B:
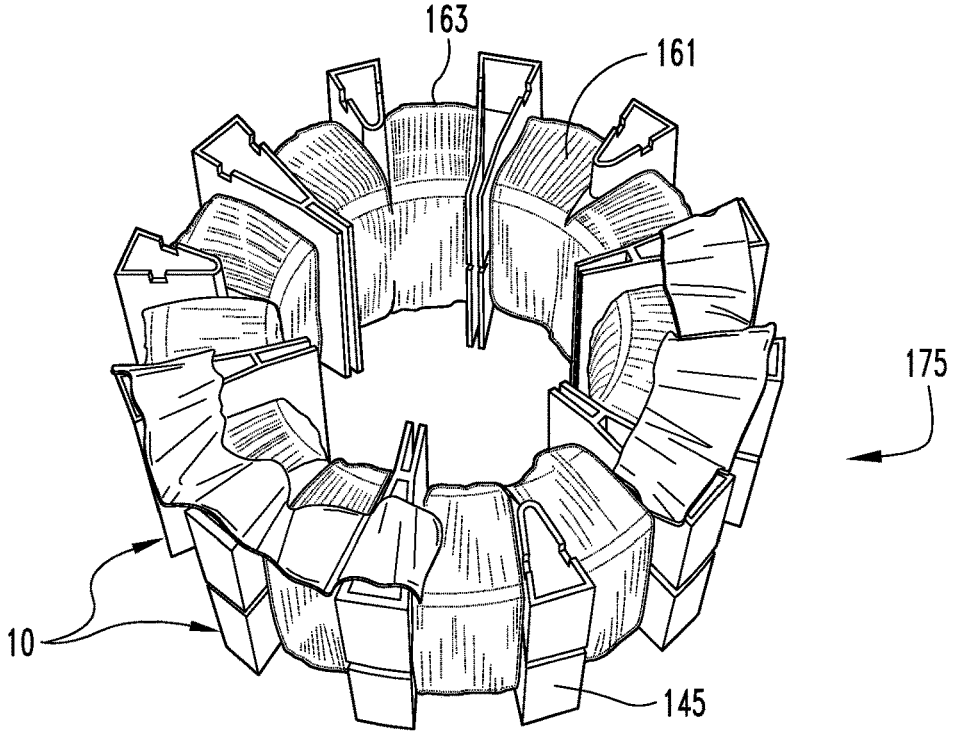
FIG. 9B is another perspective view of another partially wound core.
Figure 10:
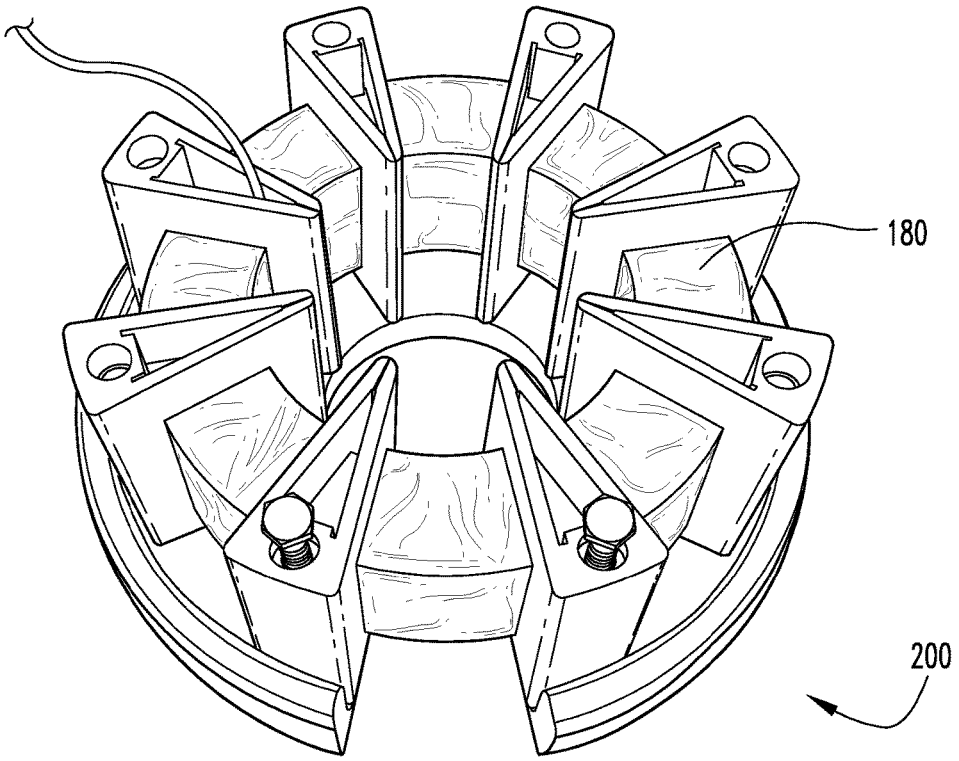
FIG. 10 is a perspective view of a toroidal transformer including the segmented core caps of the present novel technology.
Figure 11A:
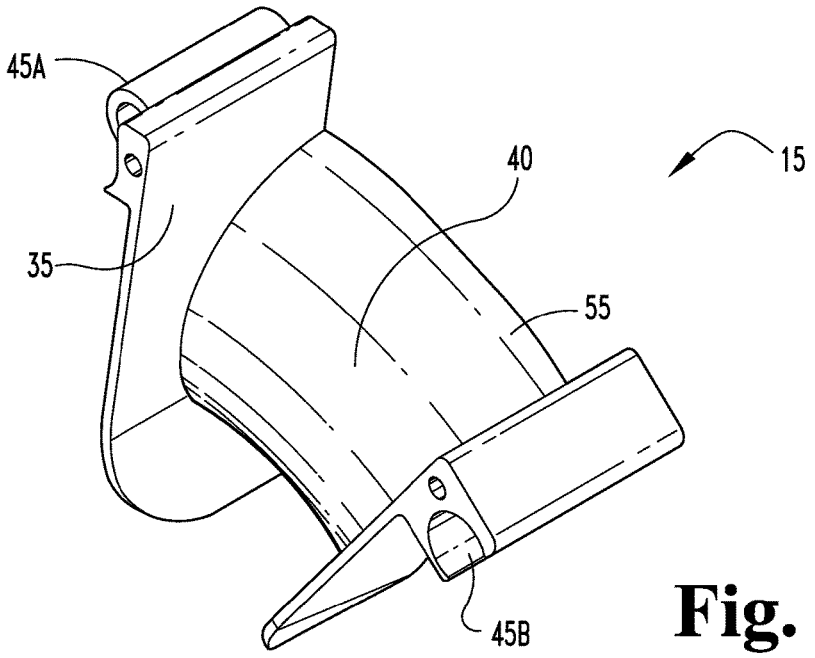
FIG. 11A is a perspective view of an eighth embodiment of the present novel technology.
Figure 11B:
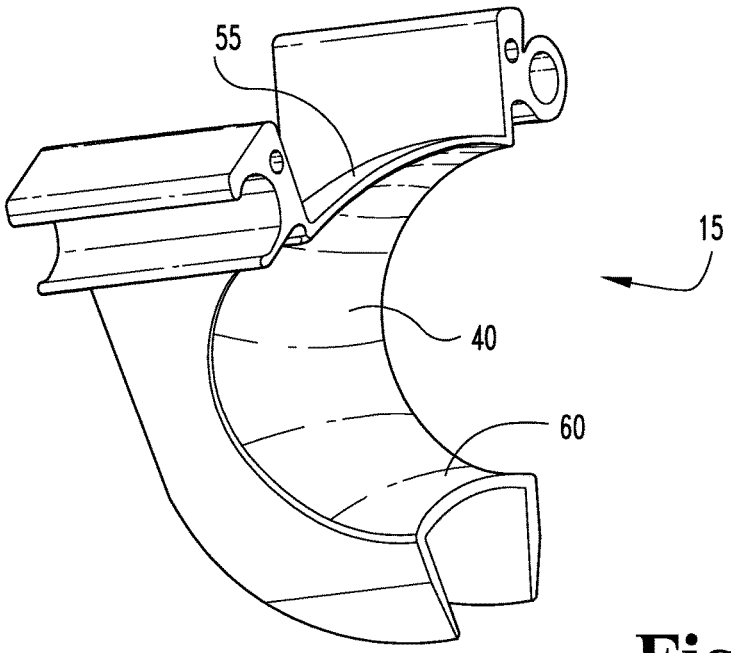
FIG. 11B is a second perspective view of FIG. 11A.
Figure 12A:
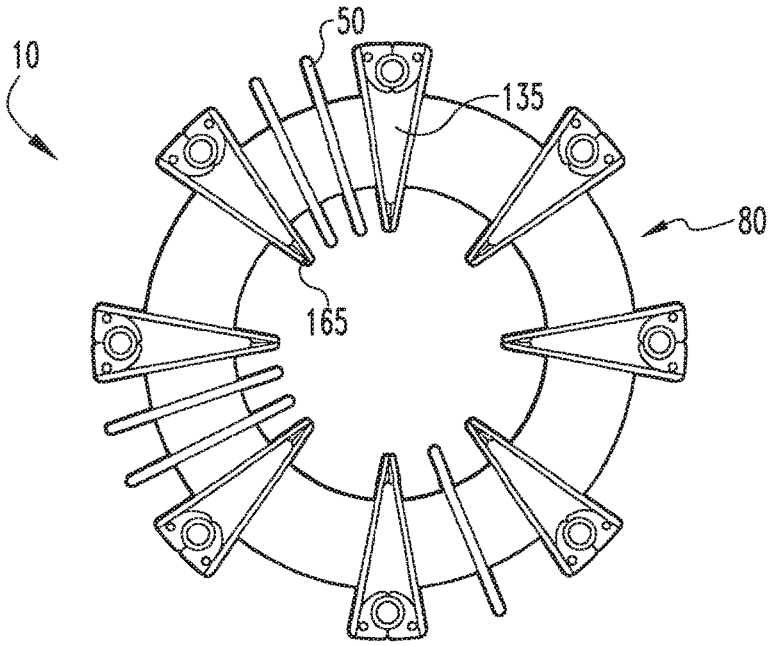
FIG. 12A is a top plan view of a ninth embodiment of the present novel technology.
Figure 12B:
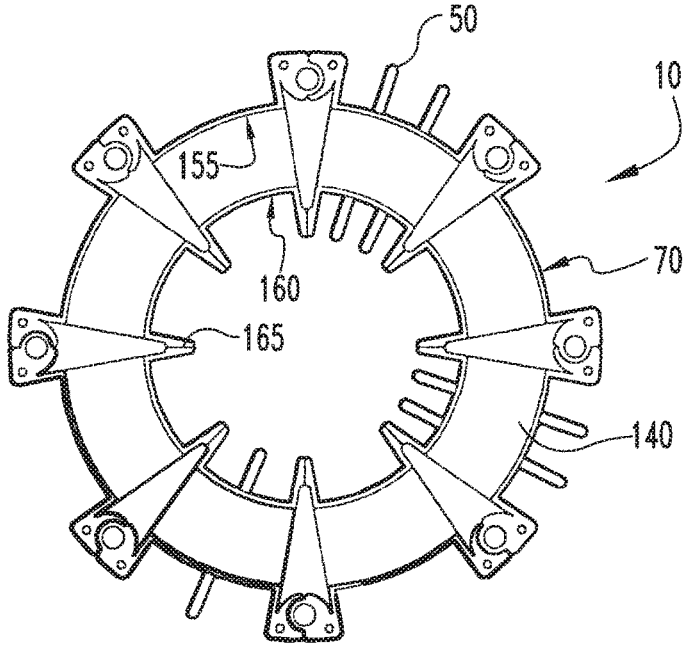
FIG. 12B is a bottom plan view of FIG. 12A.
Figure 12C:
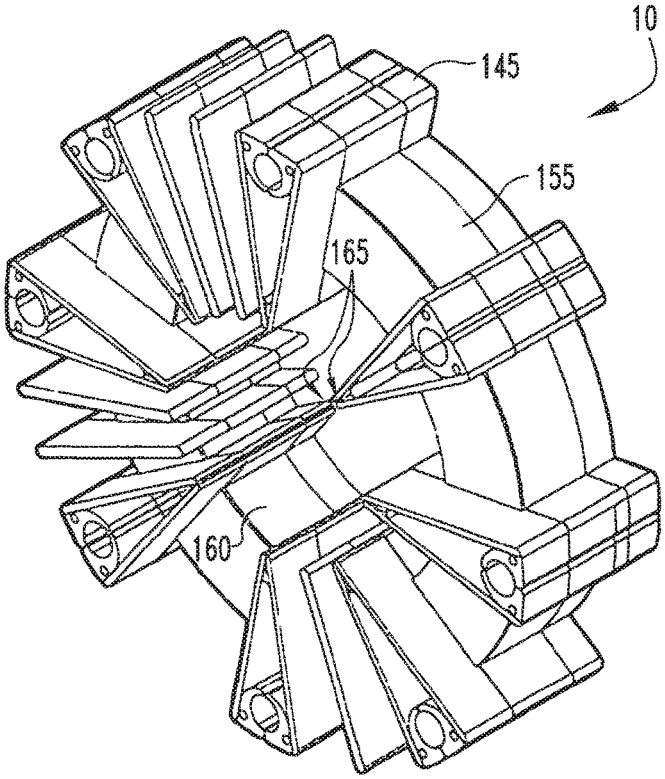
FIG. 12C is a perspective view of FIG. 12A.

Embodiments of the present novel technology are illustrated in FIGS. 2-12B, and relate to segmented or modular electrically insulating core caps 10 for supporting primary and secondary windings, typically in alternate sectors, to reduce leakage current. Pluralities of individual modular electrically insulating segments 15 typically snap, or otherwise join, together to define annular or semi-annular modular core caps 10 for covering or partially covering a (typically steel) ring-type toroidal transformer core 20. The segments or modules 15 are typically made from an insulating material, such as nylon, ZYTEL, or the like (ZYTEL is a registered trademark, reg. no. 71666270, of the E.I. Du Pont De Nemours and Company Corporation, 1007 Market Street, Wilmington, Del. 19898).

The core cap modules 15/completed core caps 10 insulate windings from the core 20 over the full range of the windings, and allow for double wall insulation between adjacent windings, significantly reducing leakage current over the prior art systems. The core cap modules 15/completed core caps 10 also provide for direct cooling of the core 20 by ambient or forced air without intervening insulation. The core 20 may be assembled from component modules 15 over a completed, wound toroidal core 20. The core caps 10 allow for winding 25 of the transformer 30 using standard winding equipment while maintaining a direct path for waste heat to escape, as there is no need for interwinding insulation that can trap heat. Further, the core caps 10 eliminate the need for center fill epoxy and/or mounting washers, so the weight of the transformer 30 is reduced.

In most embodiments, the segments 15 each include a pair of spaced, typically electrically insulating, wall members 35 between which a core covering panel portion 40 is connected. The wall members 35 intersect to define a typically wedge-shaped and/or pie-piece shaped segment 15, or a truncated wedge or pie-piece shaped segment 15 when the walls 35 would intersect at or near the center of the cap 10 if so extended, and are disposed at a predetermined angle relative to each other, typically 30 degrees, 45 degrees, 60 degrees, or the like so that each modular segment 15 spans an arc of about 30 degrees, 45 degrees, 60 degrees or the like. The respective spaced walls 35 include removably engagable, typically male and a female, connector portions 45A, 45B, respectively, such that adjacently disposed segments 15 may be repeatedly removably engaged with one another, with sufficient connected segment portions 15 defining an annular core cap 10. The number of segments 15 required to complete a core cap 10 is predetermined and is typically a function of the predetermined angle between the wall s 35; for example, if the angle is 45 degrees, eight segments 15 will be required to be connected together to define a ring 10. If the angle is sixty degrees, only six segments 15 will be required to define a ring 10. While core caps 10 are typically built from identical core cap modules 15 core caps 10 may alternately include combinations of core cap modules 15 spanning different arcs, such as four core cap modules 15 spanning forty-five degrees each and six core cap modules 15 spanning thirty degrees each. While identically sized and shaped modules 15 are typically more convenient, there are no practical restrictions on the combinations of core cap module 15 sizes and shapes that may be combined to yield a custom core cap 10 having desired properties and characteristics.

Typically, the walls 35 engage the panel 40 to define a relatively flat or flush core-engaging side or surface (defining the bottom or underside 70 of the segment 35 and ring 10, located in the downward direction) and disposed opposite the barriers 75 established by two joined or locked together walls 35 (defining by the wire-segmenting or topside 80 of the ring 10, located in the upward direction). The barriers 75 define the parameters between which alternating wire windings are restricted, typically alternating primary and secondary windings.

In some embodiments, the segments 15 include one or more separation or wall members 50 positioned to partially or completely extend across the topside 75 of the panel 40 to further define parameters between which wire windings are directed. The one or more separation members 50 are typically positioned equidistantly between the walls 35 and/or each other 50, respectively. The one or more separation members 50 are typically oriented to extend radially outwardly from the center of the core 20 and/or the annulus 10 defined by the joined segments 15; in other words, each respective separation member 50 typically lies on a radius of the annulus 10, although the separation walls 50 may have other convenient shapes and contours as desired.

In some embodiments, the segments 35 further include a core outer diameter or OD cover panel 55 and/or a core inner diameter or ID cover panel 60, both extending downwardly so as to at least partially cover the OD and ID, respectively, of a toroidal core ring placed against the core cover panels 40 of a partially or completely formed annulus 10. These panels 55, 60 may be flat for covering a core ring 20 having flat outer and inner diameter sides, or curved to follow a core ring 20 having a rounded or curved inner and outer diameter portions (see FIGS. 11A-11B)

In some embodiments, the wall members 35 are truncated and do not extend across the panels 40. In some of these embodiments, lower wall members 65 are positioned opposite the panel 40 from the respective wall members 35. The lower wall members 65 may likewise include matable connectors for co-joining.

In some embodiments, the segments 35 include ribs positioned on the upper side of the panels 40, so as to generate an air gap between wire windings and the topside 80 of the ring 10. The production of an air gap facilitates air cooling of windings by allowing air to circulate between windings and the topside 80 of the cap 10.

In some embodiments, a winding tool 100 is included to facilitate the winding of a capped core from a single bobbin. The winding tool 100 is typically a flat ring 105 having a projecting rim or flange no extending from the outer diameter thereof. The ring 100 typically includes a slot 115 formed there through, such that the ring no has a C-shape. The ring no is sized to accept a segment 15 therein, with the slot 115 sized to pass wire onto a segment 15 aligned therewith. Winding tool 100 further typically includes an elongated arced wire lock member 120 having a plurality of slots 125 formed partially therethrough and one or more locking apertures 127 formed therethrough for connecting the wire lock member 120 to one or more segments 15 during the wire winding process.

In operation, a plurality of segments 15 may be connected to one another to define a ring 10. The ring 10 includes an annular core top cover portion 140 defined by the panels 40 of the individual segments 15. In most embodiments, the ring 10 also includes (typically) equidistantly spaced radial protrusions 145, defined by mutually engaged connectors 45A, B, extending outwardly from the ring 10. Each radial protrusion 145 is typically part of an elongated wall member 135 positioned on the topside 80 of the ring 10 and extending radially inwardly partway or completely across the topside surface 80. Some of the walls 135 terminate in radial protrusions 165 extending inwardly from the ring 10. These radial protrusions 165 are typically formed from the joinder of two lower walls 65, although they may be formed separately.

The ring 10 may also include an annular core outer diameter cover member 155 and/or an annular core inner diameter cover member 160, each cover member 155, 160 positioned generally perpendicular to the core top cover portion 140 and extending downwardly away therefrom. The respective cover members 155, 160 are typically composed of adjacent cover panels 55, 60 when the segments 15 are connected to define the ring 10.

Typically, a pair of cap rings 10 are constructed from connected segments 15 and positioned on opposite sides of a toroidal core 20 with outward protrusions 145 aligned. Typically, an even number of segments 15 are connected to make each ring 10. Wire is wound contiguously around alternating segments 15 to define the primary windings 161, with N windings per segment 15. Wire is wound contiguously around the remaining segments 15, in multiples of N windings per segment 15, to define the secondary windings 163. Typically, all of the windings 161, 163 may be accomplished from a single bobbin or shuttle in one contiguous bobbin winding 25 operation, with wire guided from one segment 15 to the next through the groove or gap 170 between the two opposite core caps 10. The wire is typically cut or severed to isolate the primary windings 161 from the secondary windings 163, and the wound core 175 may then be wrapped in insulation 180 to define a toroidal transformer 200. In some embodiments, the winding tool 100 may be utilized to facilitate core winding. Coils 20 so wound retain the advantages of toroidal transformers while enjoying the benefits of being lighter, smaller, more efficient and quieter than E-I laminate cores. Cores 20 so wound exhibit reduced interwinding leakage current when compared with standard wound toroidal transformer cores.

Typically, the primary windings 161 will occupy the odd numbered segments 15, starting with the first segment wound, and the secondary windings 163 will occupy the even numbered segments 15. In some embodiments, each ring 10 may contain multiples of three segments 15, such as six, nine, or twelve, and the core 20 may be wound with primary 161, secondary 163 and tertiary (not shown) windings as above to yield a three-phase transformer. In other embodiments, the ring may contain segments 15 having different configurations (see FIGS. 12A-12C).

In some embodiments, an insulating material, such as a MYLAR strip, is positioned to cover the portion of the core 20 exposed by the gap 170. In other embodiments, the core 20 is partially or completely wrapped in an insulating material prior to the positioning of the cap(s) 10 thereupon. In still other embodiments, wall members 35 are spaced and oriented relative each other to define an annulus, but are not physically connected to each other. In most embodiments, the wire wrapping the core 20 is sheathed in an insulating layer or film.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

We claim:

1. A modular toroidal transformer core cap system, comprising:
   - a plurality of cap segments, wherein each respective cap segment further comprises:
     - first and second spaced elongated wall members;
     - a first connector member connected to the first elongated wall member;
     - a second connector member operationally connectable to a respective first connector member of another respective cap segment and connected to the second elongated wall member;
     - a generally flat panel member connected to and extending between the first and second elongated wall members;
     - wherein the first and second wall members are disposed at a predetermined angle relative one another;
     - wherein the angle between the first and second spaced elongated walls defines an arc;
     - wherein the first and second wall members cooperate to define a wedge; and
     - wherein the first and second elongated wall members and the panel member are electrically nonconducting; and
   - wherein an integral number of cap segments may be removably engageably joined together to define an annular core cap.

2. The modular toroidal transformer core cap system of claim 1 wherein the angle between the first and second elongated wall members is 30 degrees.

3. The modular toroidal transformer core cap system of claim 1 wherein the angle between the first and second elongated wall members is 60 degrees.

4. The modular toroidal transformer core cap system of claim 1 wherein the angle between the first and second elongated wall members is 45 degrees.

5. The modular toroidal transformer core cap system of claim 1 and further comprising a first elongated curved cover member extending between the first and second elongated wall members and a second spaced elongated curved cover member extending between the first and second elongated wall members, wherein the respective cover members are oriented generally perpendicular to the panel member and wherein the panel member is disposed between the respective spaced cover members.

6. The modular toroidal transformer core cap system of claim 1 wherein the segments are made of nylon.

7. An annulus for covering a toroidal transformer core to facilitate winding, comprising:
   - a plurality of connected annulus segments, each respective segment further comprising;
     - at least two spaced elongated support members defining an arc;
     - a first fastener connected to the first elongated support member;
     - a second fastener connected to the second elongated support member, wherein the first and second fasteners are removably engageable with respective second and first fasteners of other respective annulus segments;

a generally flat core cover member extending between the first and second elongated support members;

wherein the first and second support members are disposed at a predetermined angle relative one another; and wherein the first and second elongated support members and the flat core cover member are electrically nonconducting; and wherein a predetermined number of annulus segments may be joined together to define the toroidal core covering annulus.

8. The annulus of claim 7 wherein the respective generally flat core cover members collectively define a core covering ring.

9. The annulus of claim 7 wherein each segment further comprises a core outer diameter cover member extending between the first and second elongated support members and a spaced core inner diameter cover member extending between the first and second elongated support members, wherein the respective diameter cover members are oriented generally perpendicular to the respective flat core cover members and wherein the respective flat core cover members are disposed between the respective spaced diameter cover members.

10. The annulus of claim 7 wherein the angle between the first and second elongated support members is selected from the group comprising 30degrees, 45 degrees, and 60 degrees.

11. A ring cap system for covering a toroidal transformer core, comprising:

a plurality of ring segments, each respective ring segment further comprising;

at least two spaced elongated support members;

a first fastener extending from the first elongated support member;

a second fastener matingly connectible to a respective first fastener of another respective ring segment and extending from the second elongated support member, wherein the first and second connectors are repeatedly removably engageable; and a flat core cover member extending between the first and second elongated support members;

wherein the first and second support members are disposed at a predetermined angle relative one another; and wherein the first and second elongated support members and the flat core cover member are electrically nonconducting; and wherein a predetermined number of annulus segments may be joined together to define a toroidal core covering ring.

12. The system of claim 11 wherein the predetermined number is six.

13. The system of claim 11 wherein the predetermined number is eight.

* * * * *